United States Patent [19]

Tyler

[11] Patent Number: 5,067,451

[45] Date of Patent: Nov. 26, 1991

[54] RECOIL SPRING END RETAINER

[75] Inventor: Rex A. Tyler, Charlotte, Mich.

[73] Assignee: Eaton Indiana, Inc., Nappanee, Ind.

[21] Appl. No.: 567,100

[22] Filed: Aug. 14, 1990

[51] Int. Cl.[5] ..... F02N 3/02

[52] U.S. Cl. ..... 123/185 BA; 185/45; 267/156

[58] Field of Search ..... 123/185 B, 185 BA; 185/45; 267/156

[56] References Cited

U.S. PATENT DOCUMENTS

| | | | |
|---|---|---|---|
| 2,530,623 | 11/1950 | Martin | 123/185 BA |
| 2,848,987 | 8/1958 | Morden | 123/185 BA |
| 3,393,707 | 7/1968 | Whiting | 267/156 |
| 3,782,355 | 1/1974 | Hamman | 123/185 B |
| 3,858,566 | 1/1975 | Perry | 123/185 BA |
| 4,068,644 | 1/1978 | Newport | 123/185 BA |
| 4,492,190 | 1/1985 | Greenwood et al. | 123/185 A |
| 4,582,030 | 4/1986 | Reese | 123/185 B |
| 4,658,775 | 4/1987 | Greenwood et al. | 123/185 B |

*Primary Examiner*—Andrew M. Dolinar

*Attorney, Agent, or Firm*—Beaman & Beaman

[57] ABSTRACT

A rope pulley for an internal combustion engine recoil starter using a spiral recoil spring to rewind the starter rope upon the pulley. The improvement consists of the use of a recoil spring end lock defined on the pulley to prevent the spring end from disengaging from its anchor on the pulley during recoiling or due to pulley deformation. The spring end lock consists of a cap plate associated with the pulley slot forming the recoil spring anchor and a retainer wall all related in a manner to achieve the desired result.

3 Claims, 1 Drawing Sheet

RECOIL SPRING END RETAINER

BACKGROUND OF THE INVENTION

Recoil starters for internal combustion engines, such as of the smaller sizes as commonly used on lawn mowers, snow blowers, generators, outboard motors, and the like, commonly employ a pulley defining a groove in which the starter rope is coiled. Upon tensioning of the starter rope the pulley is rotated and connected to the engine to crank and start the engine. Recoiling of the rope upon the starter rope pulley is accomplished through a spiral spring connected to the pulley and a stationary anchor whereby the spring is wound during the cranking rotation of the pulley, and the resiliency of the spring rotates the pulley in the opposite direction to retract the starter rope and rewind the rope upon the pulley groove.

As the technology of recoil starters has developed it is now common practice to shape the pulley rope receiving groove of a particular configuration to facilitate rope re-winding and reduce the force required during pulley rotation while cranking, and it is now common to form the starter rope pulley of synthetic plastic as formed by injection molding processes. Examples of engine recoil starters using spiral springs for recoil purposes, and employing synthetic plastic pulleys, are shown in the assignee's U.S. Pat. Nos. 3,782,355 and 4,492,190.

As the desire for lower profile starters of economical construction has increased recoil starter designers have met the challenges and synthetic plastic starter recoil pulleys are now available wherein the recoil spring is substantially housed within the axial configuration of the rope pulley and the synthetic plastic material forming the pulley also functions as a housing for the recoil spring. However, such construction has created problems in that the very high radial forces existing within the spring as imposed upon the synthetic plastic material of the rope pulley will cause the pulley material to cold flow or "creep" which changes the dimensional conformity of the pulley, and one of the problems that has arisen from such pulley material cold flowing pertains to the retention of the recoil spring anchor upon the pulley.

It is common to form the ends of the spiral recoil spring with a partial loop or hook formed of the spring material. This hook is received within anchor pins, slots or recesses defined on the pulley housing or engine structure, and normally, the resiliency of the spring in a rotative unwinding direction tending to maintain the spring end hooks in engagement with their anchors is sufficient to maintain the desired assembly between the spring and its hooks. However, upon the occurrence of pulley dimensional change due to cold flowing of the pulley material it is possible that, over a period of time, the dimensional changes may be of such value as to permit the spring end hook associated with the pulley to disengage from its pulley anchor slot rendering the recoil spring inoperable.

This tendency to disengage the recoil spring hook from its associated pulley anchor slot is also aggravated by the inertial dynamics occurring during pulley reversals in that during the sudden stopping and starting of the pulley rotation the inertial rotative movements of the spring and pulley will tend to disengage the spring end hook from its slot.

Previously, solutions to the aforedescribed problems with respect to recoil starter rope pulleys have not been successfully overcome.

It is an object of the invention to provide a rope pulley construction for engine recoil starters wherein the recoil spring includes a hook associated with a slot anchor defined in the pulley and a spring end lock is defined on the pulley for maintaining the engagement between the spring end and the pulley under dimensional pulley stress or inertial dynamics.

Another object of the invention is to provide a rope pulley construction of synthetic plastic material wherein the configuration of the pulley includes a recess for receiving the spiral recoil spring and the anchor between the pulley and outer spring end is of such configuration to maintain the spring-pulley anchor connection even under dimensional changes of the pulley due to cold flow of the pulley material.

In the practice of the invention a rope pulley for an engine recoil starter includes a hub whereby the pulley may be concentrically rotatably mounted relative to a rotating engine part, usually the crankshaft. Unidirectional clutch structure, which constitutes no part of the instant invention, is used to connect the pulley hub to the engine during rotation of the rope pulley in an engine cranking direction. During recoil rotation of the rope pulley in the rope retracting direction the pulley is disengaged from the engine structure, and such disengagement also occurs when the engine starts.

The synthetic plastic pulley includes a peripheral region in which a groove is defined by flanges for receiving the starter rope, the rope being coiled within the groove when the rope is retracted by recoiling, and tensioning of the rope rotates the pulley to crank the engine.

The pulley includes a recoil spring receiving recess concentrically related to the pulley axis of rotation, and the spring recess is substantially in radial alignment with the rope receiving groove and is outwardly defined by an axially extending wall against which the outer coils of the spring engage. The outward radial forces of the spring are imposed against this axial pulley wall.

The spring receiving recess axial wall is provided with an elongated axially extending slot which receives the outer hook end of the recoil spring. The spring hook end extends through the slot forming a positive connection between the spring and pulley for imposing a torque force on the pulley during rope recoiling, and as the engine is cranked the pulley imposes a torsional winding force upon the spring.

Spring outer end locking features are defined on the pulley structure which coordinate with the dimensions and form of a spring end hook to maintain proper hook position once assembled. A primary feature of the lock is a radially extending cap plate which is reinforced against axial deflection by a homogeneous web extending between the cap plate and the adjacent pulley flange. The cap plate is superimposed over a portion of the spring hook end received within the pulley slot in an axial direction corresponding to the "open" end of the slot and the spring receiving recess. Accordingly, the cap plate prevents the coil spring end from axial displacement in the direction toward the open end of the anchor slot and the retainer cap plate effectively assures engagement and proper positioning of the recoil spring outer hook end with the pulley slot anchor even though limited axial displacement of the spring in the direction of the open ends of the spring receiving recess and anchor slot may have occurred.

Dynamic movement of the spring end in a direction which will remove the spring end hook from the pulley slot only occurs when the spring is not wound tightly and wherein several spring coils are stacked in contiguous relationship against the pulley recess in which the spring coil is located. In such instance the movement of the outer spring hook will be tangential to the spring receiving pulley recess and in such instance the rear end of the hook will engage the rear of the pulley slot before the free end of the hook moves out from under the cap plate. During assembly, the spring can be wound closely to the axis of the pulley allowing the tangential extension of the outer end of the spring to be a position which passes through the pulley slot at an angle. The configuration of the cap plate and its associated structure is such as to permit ease of assembly of the spring to the pulley and its slot, and yet, under operating conditions the spring end is locked with respect to the pulley slot and is retained against axial displacement.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
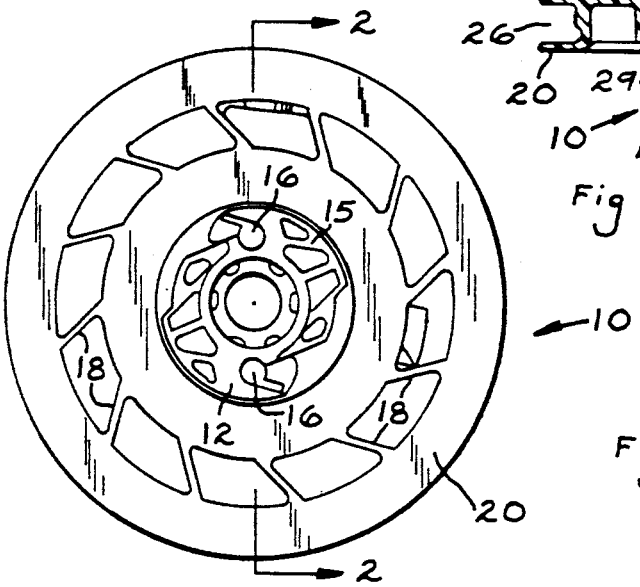
FIG. 1 is a plan view of the side of an engine starter recoil pulley upon which the clutch structure is associated constructed in accord with the invention.

A recoil starter pulley constructed in accord with the invention is preferably formed of a synthetic plastic material injected into appropriate molds. The configuration of a typical starter pulley utilizing the inventive concepts is shown in the drawings. The pulley 10 includes a hub 12 concentric with the pulley axis of rotation, and the hub includes a central bore 14 wherein the pulley may be rotatably mounted upon a shaft, not shown, mounted upon the engine to be cranked, not shown. The hub portion 15, on the side of the pulley as illustrated in FIG. 1, includes structure for supporting the clutch dogs which selectively drivingly interconnect the starter pulley with the engine drive cup, not shown. The starter structure includes a pair of partially cylindrical sockets 16 for receiving the ends of starter dogs, and the dog configuration is not shown as it constitutes no part of the present invention.

The hub portion 15 is surrounded by a dog actuation cup, not shown, which may function in a manner similar to that shown in the assignee's U.S. Pat. No. 3,081,760.

The pulley includes, on the side shown in FIG. 1, a plurality of ribs 18 which merge into the peripheral region flange 20 which forms a part of the rope receiving groove. On the opposite side of the pulley 10, as will be appreciated from FIGS. 2 and 3, the pulley includes a recoil spring receiving recess generally indicated at 22 radially outwardly located with respect to the hub 12, and inwardly of the radial flange 24 axially spaced with respect to the flange 20.

The flanges 20 and 24 constitute the peripheral region of the pulley, and together, define the rope receiving groove 26 for receiving the starter rope, not shown, in a manner similar to that shown in the assignee's U.S. Pat. Nos. 3,782,355 and 4,492,190.

Figure 2:
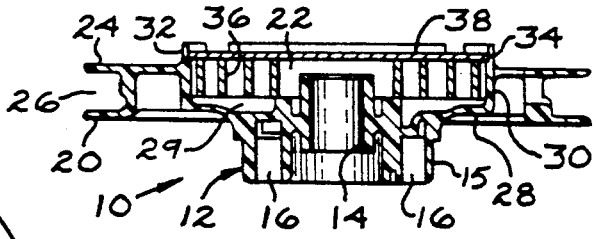
FIG. 2 is an inverted elevational sectional view of the pulley as taken along Section 2—2 of FIG. 1.

The spring receiving recess 22 includes a radial wall portion 28, FIG. 2, radial spring coil supporting ribs 29, an axially extending cylindrical wall portion 30, and the recess is located between the central bore 14 and the rope receiving groove 26. The end 32 of the spring receiving recess 22 opposite to that defined by the radial wall 28 is "open" and a beveled groove 34 is defined therein for receiving the spring cover plate as later described.

The spiral recoil spring 36, FIG. 2, is received within the recess 22 and is located between the radial ribs 29 and the circular spring cover plate 38 which snaps into the circular groove 34 formed adjacent the recess open end 32. In this manner the coil spring 36 will be retained in its coiled relationship by the recess wall 30.

Figure 3:
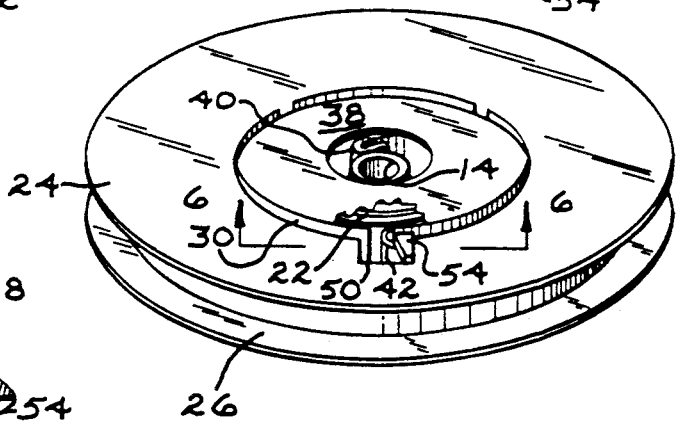
FIG. 3 is a perspective view, partially broken away, of the opposite side of the pulley with respect to that shown in FIG. 1, a portion of the spring cover plate being broken away.

The inner end of the spring 36 is provided with the hook 40, FIG. 3, formed by bending the end of the spring back upon itself, and the hook 40 cooperates with a fixed anchor, such as a pin, not shown, mounted upon the housing, not shown, for the recoil starter structure. The outer end of the recoil spring 36 is also bent to form a hook 42 for cooperation with the pulley anchor slot as described below.

Figure 5:
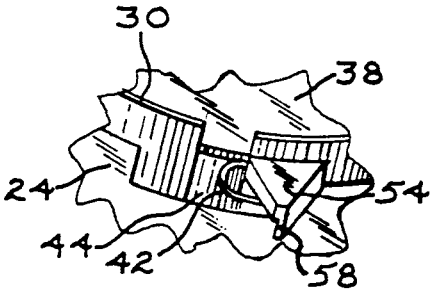
FIG. 5 is an enlarged, detailed perspective view of the rope pulley anchor slot and cap plate retainer.
Figure 4:
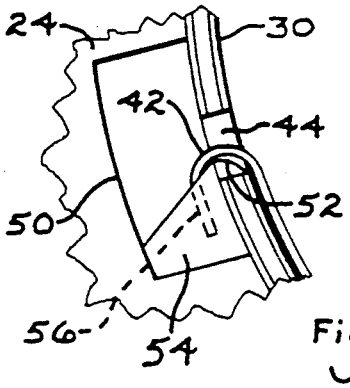
FIG. 4 is an enlarged detail plan view of the recoil pulley anchor slot and cap plate retainer.
Figure 6:
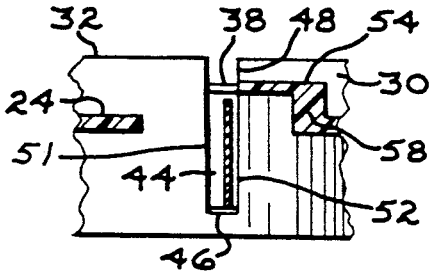
FIG. 6 is an elevational detail sectional view of the pulley slot region as taken along Section 6—6 of FIG. 3.

The pulley recess wall 30 is slotted at 44, FIGS. 4–6, wherein the elongated slot 44 intersects the open end 32 of the wall and terminates adjacent the recess wall 28. The slot end 46 constitutes the closed end while the slot end 48 constitutes the open end of the slot. The slot includes a lock edge 51 and an anchor edge 52. A rectangular opening 50 is defined in the flange 24 in radial alignment with the region adjacent the slot 44.

The spring hook 42 retainer or lock includes a cap plate 54 homogeneously formed of the material of the pulley extending from the outside of the recess wall 30 adjacent the slot open end 48. As will be appreciated from the drawings, the cap plate 54 is located adjacent the slot edge 52 about which the spring hook 42 passes, and the cap plate is axially superimposed over the outermost end 56 of the spring hook.

A homogeneous reinforcing web 58 extending between the cap plate 54, wall 30 and flange 24 strengthens the cap plate 54 against axial deformation assuring the necessary resistance of the cap plate against axial forces imposed thereon by the spring hook end 56.

Figure 7:
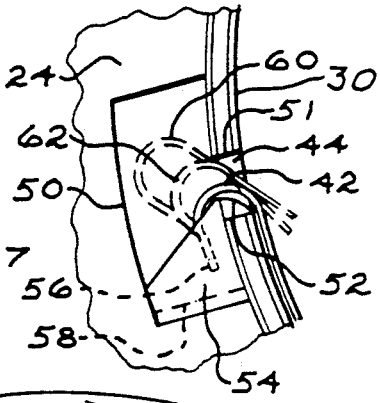
FIG. 7 is a view similar to FIG. 4 showing the spring end in various positions to the pulley slot.

The sequence of assembling the hook 42 with respect to the pulley slot 44 is illustrated in FIG. 7. The position of the slot 44, and the presence of the opening 50, permit the spring end region to be placed obliquely through the slot with the hook 42 in the central area of opening 50 in a manner shown in phantom lines at 60. Subsequent release of the spring hooked end and winding of the coil spring 36 will draw the hook toward its position as shown in phantom lines at 62. Continued winding of the coil spring causes the hook 42 to snap past the slot edge 51 and engage the slot edge 52 and the spring end becomes captive under the cap plate 54.

Once assembled, the hook 52 becomes locked in its operative position within the slot 44 and under the cap plate 54. During operation of the starter the tendency of the hook to move out of its operative position only occurs when the spring is under lower tension and the coils are located closely toward the recess wall 30. Under these conditions the spring end is held in a tangential relationship to the recess wall 30 by the adjacent coils and the hook 42 can only move tangentially and then only slightly since it is confined by the edge 51 of the slot 44.

In manufacture, it will be appreciated that it is necessary to put a slight draft angle on the spring receiving recess wall 30 in order to permit the pulley 10 to be removed from its mold, and accordingly, a slight conical configuration will necessarily be imparted to the wall 30. This fact, plus the fact that the recess wall 30 is continually subjected to an outward radial force by the recoil spring 36 causes the synthetic plastic material of the pulley and wall 30 to slowly cold flow in an outward direction. The fact that the wall 30 is closed by the wall 28, but substantially open at the end 32, causes the wall 30 to further form a conical configuration due to cold flow of the pulley material, and while these dimensional changes are small, they are sufficient to permit the spring 36 to axially move in the direction of the cover plate 38 possibly causing the cover plate 38 to move within the groove 34. Such axial migration of the spring 36 relative to the recess 22 may permit the spring hook 42 to disengage from the slot 44 and render the recoil spring inoperative to rewind the starter rope into the groove 26. However, the presence of the cap plate 54 superimposed over the spring hook 42 in the direction of possible spring migration retains the spring within the anchor slot 44 maintaining the pulley in an operative condition.

Additionally, inertial forces imposed upon the pulley 10 during retraction or rope rewinding may also tend to permit the spring hook 42 to disengage from the anchor slot 44, and the presence of the cap plate 54 discourages such disengagement.

The presence of the cap plate 54 does not interfere with the assembly of the recoil spring with the pulley, and the presence of the cap plate 54, as reinforced by the web 58, produces an effective manner for overcoming the aforedescribed situations with respect to possible inadvertent separation of the spring end from the anchor slot.

It is appreciated that various modifications to the inventive concepts may be apparent to those skilled in the art without departing from the spirit and scope of the invention.

I claim:

1. In a rope pulley for an engine recoil starter wherein the pulley comprises a circular body having an axis, a central hub, a periphery, first and second spaced flanges defining a peripheral rope receiving groove, and a recoil spring receiving recess substantially concentric to the hub radially located intermediate the hub and the periphery having an axially extending outer wall and an open end adjacent the first flange, the improvement comprising, an elongated axially extending slot defined in the recoil spring receiving recess wall intersecting the recess open end for receiving the bent outer end of a spiral recoil spring located within the spring receiving recess, and a spring retainer abutment defined on the first flange adjacent said slot comprising a web extending from the first flange and a cap plate mounted on said web transversely disposed to the length of said slot, said cap plate adapted to be axially aligned with and overlying a bent spring outer end received within said slot to prevent axial movement of the spring end relative to said slot in the axial direction toward said cap plate and the recess open end.

2. In a rope pulley for an engine recoil starter as in claim 1, the body being injection molded of synthetic plastic material, said web and cap plate being homogeneously formed of the material of said body.

3. In a rope pulley for an engine recoil starter wherein the pulley comprises a circular body injection molded of synthetic plastic material having an axis, a central hub, a periphery, a peripheral rope receiving groove, and a recoil spring receiving recess substantially concentric to the hub radially located intermediate the hub and the periphery having an axially extending outer wall and a radial wall, the improvement comprising, an elongated axially extending slot defined in the recoil spring receiving recess wall for receiving the bent outer end of a spiral recoil spring located within the spring receiving recess, said slot including a closed end disposed toward the recess radial wall and an open end remote from said closed end, and a spring retainer abutment homogeneously defined on the pulley by the plastic material thereof and adjacent said slot open end comprising a cap plate transversely disposed to the length of said slot, the pulley body including a radial flange wall adjacent said slot's open end, an axially extending cap plate reinforcement web homogeneously connected to said cap plate and said flange wall reinforcing said cap plate against axial forces imposed thereon, said retainer abutment cap plate adapted to be axially aligned with a spring end associated with said slot to prevent axial movement of the spring end relative to said slot in the axial direction toward said slot open end.

* * * * *